US009428352B2

(12) United States Patent
Niikura et al.

(10) Patent No.: US 9,428,352 B2
(45) Date of Patent: Aug. 30, 2016

(54) SHEET FEEDING DEVICE AND IMAGE FORMING APPARATUS

(71) Applicants: Yasuo Niikura, Kanagawa (JP); Takashi Fukumoto, Kanagawa (JP); Hideaki Takahashi, Kanagawa (JP)

(72) Inventors: Yasuo Niikura, Kanagawa (JP); Takashi Fukumoto, Kanagawa (JP); Hideaki Takahashi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 23 days.

(21) Appl. No.: 14/613,544

(22) Filed: Feb. 4, 2015

(65) Prior Publication Data

US 2015/0225191 A1 Aug. 13, 2015

(30) Foreign Application Priority Data

Feb. 7, 2014 (JP) ..... 2014-022138
Jan. 20, 2015 (JP) ..... 2015-008289

(51) Int. Cl.
*B65H 1/26* (2006.01)
*B65H 1/14* (2006.01)
*B65H 1/04* (2006.01)

(52) U.S. Cl.
CPC ..... *B65H 1/266* (2013.01); *B65H 1/04* (2013.01); *B65H 1/14* (2013.01); *B65H 2405/11164* (2013.01); *B65H 2405/15* (2013.01); *B65H 2405/324* (2013.01); *B65H 2701/1131* (2013.01)

(58) Field of Classification Search
CPC ..... B65H 1/266; B65H 1/04; B65H 1/14; B65H 1/027; B65H 2405/324; B65H 2405/11164; B65H 2405/15
See application file for complete search history.

(56) References Cited

U.S. PATENT DOCUMENTS

| | | | | |
|---|---|---|---|---|
| 8,608,160 | B2 * | 12/2013 | Shinagawa | B41J 13/103 271/145 |
| 2008/0297580 | A1 | 12/2008 | Fukumoto et al. | |
| 2009/0014948 | A1 | 1/2009 | Takahashi | |
| 2011/0074090 | A1 * | 3/2011 | Yanagishita | B65H 1/266 271/10.01 |
| 2011/0292148 | A1 * | 12/2011 | Shinagawa | B65H 1/266 347/104 |
| 2012/0313315 | A1 | 12/2012 | Fukumoto et al. | |
| 2014/0339759 | A1 | 11/2014 | Takahashi et al. | |
| 2015/0048566 | A1 | 2/2015 | Utagawa et al. | |
| 2016/0016740 | A1 * | 1/2016 | Niikura | B65H 1/04 271/162 |

FOREIGN PATENT DOCUMENTS

JP 06-092486 4/1994

* cited by examiner

*Primary Examiner* — Patrick Cicchino
(74) *Attorney, Agent, or Firm* — Harness, Dickey & Pierce, P.L.C.

(57) ABSTRACT

There are provided a plurality of slide rails that are attached to a sheet feeding device; a box-shaped pullout unit that is movable toward an image forming unit on the slide rails; a slide unit and an extended tray that are arranged in the front and back positions in a direction in which the pullout unit moves; a slide bottom plate that is movable up and down by a loading unit and that is slidable on the pullout unit in a horizontal direction; a front-edge sheet positioning unit that raises up when the slide bottom plate is pulled out in a horizontal direction and that falls down when the slide bottom plate is pushed in a horizontal direction; and a connection unit that connects to a handle for pulling out the pullout unit in a horizontal direction when the slide bottom plate is located at a lowest point.

9 Claims, 20 Drawing Sheets

SHEET FEEDING DEVICE AND IMAGE FORMING APPARATUS

CROSS-REFERENCE TO RELATED APPLICATIONS

The present application claims priority to and incorporates by reference the entire contents of Japanese Patent Application No. 2014-022138 filed in Japan on Feb. 7, 2014 and Japanese Patent Application No. 2015-008289 filed in Japan on Jan. 20, 2015.

BACKGROUND OF THE INVENTION

1. Field of the Invention

The present invention relates to a sheet feeding device and an image forming apparatus.

2. Description of the Related Art

In recent years, the printing market has increasing needs for a printout on elongated sheets, such as coated sheets, in the fields of book covers, facing pages of catalogs, POP advertising, or the like, and there is also demand for a printout on elongated sheets and an increase in the number of loaded elongated sheets in the PP business field. Here, POP is an abbreviation for Point of purchase advertising, and PP is an abbreviation for Production Printer.

For a printout on elongated sheets by using copiers, it is difficult to supply the sheets to a commonly used sheet feeding tray, as the length of the elongated sheets is different from the length of regular sheets; therefore, there is an already-known technology for gradually supplying sheets for printing by using a manual feed tray, or the like, that is installed in a copier.

However, it is difficult to load a large quantity of elongated sheets by using conventional manual feed trays of copiers. Furthermore, even if they are loaded, they cannot be stored in a stable state as the manual feed tray causes the sheets to be exposed on the outside of a chassis; therefore, there is a need to previously take, from a pack of sheets, the sheets enough for printing and supply them for printing, which results in the problem of a decrease in the printing operation efficiency.

Furthermore, there is a problem in that, during a supply of elongated sheets, it is difficult to place the sheets even by using a manual feed tray due to the characteristics of the sheets, i.e., the weight of loaded sheets is heavy, or elongated sheets are bent more than regular sheets when they are lifted up because the elongated sheets are longer than the regular sheets. Furthermore, there is a problem in that, if a sheet feeding tray, such as a commonly used large-capacity sheet feeding tray unit (hereinafter, referred to as the "LCT"), is designed for elongated sheets, the size of the sheet feeding tray is increased and the size of the overall sheet feeding device is increased, which results in an increase in the installation space for the sheet feeding device.

The technology that is described in Japanese Patent Application Laid-open No. 06-092486 is intended to allow a supply of sheets in a high position and improve the operability. Japanese Patent Application Laid-open No. 06-092486 discloses the configuration of a sheet feeding device that includes a sheet container that is made up of a box-shaped open-topped frame member and that can be pulled out toward the front side of a main body on rails; a bottom plate that is located inside the sheet container and that moves vertically with a large quantity of sheets loaded thereon; a bottom-plate drive unit that lifts and lowers the bottom plate; and a sheet feeding unit that feeds the loaded sheets from the upper side, wherein the sheet feeding device includes a small tray that is located in the upper section of the sheet container to supply the sheets onto the bottom plate and includes a guide unit for pulling out the small tray toward the front side.

However, the technology that is described in Japanese Patent Application Laid-open No. 06-092486 does not resolve the problem of an increase in the installation space for the sheet feeding device because the size of the sheet feeding tray is increased if the tray is designed for elongated sheets.

Therefore, it is desirable to provide a sheet feeding device that can store elongated sheets in a stable manner and that can supply sheets with high-accuracy positioning without making major changes on the structure of the existing tray.

SUMMARY OF THE INVENTION

It is an object of the present invention to at least partially solve the problems in the conventional technology.

According to an aspect of the present invention, there is provided a sheet feeding device including: a loading unit that lifts and lowers a loaded sheet; a sheet-end positioning unit that adjusts a position of an end of the sheet; a conveying unit that conveys the sheet to an image forming apparatus main body; a plurality of slide rails that are attached to the sheet feeding device; a pullout unit that is movable toward the image forming apparatus main body on the slide rails; an extended tray that is installed on a slide bottom plate so as to extend therefrom; the slide bottom plate that is movable up and down by the loading unit and that is slidable on the pullout unit in a horizontal direction; a front-edge sheet positioning unit that raises up when the slide bottom plate is pulled out in a horizontal direction and that falls down when the slide bottom plate is pushed in a horizontal direction; and a connection unit that connects to a handle for pulling out the pullout unit in a horizontal direction when the slide bottom plate is located at a lowest point.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Summary

An embodiment of the present invention is explained. The present invention has the following characteristics in regard to a supply of elongated sheets to a sheet feeding tray.

In short, when elongated sheets are to be placed, a slide bottom plate is pulled out for a supply of the sheets, the slide bottom plate being slid on a bottom plate of an existing sheet feeding tray in a horizontal direction; thus, sheet placement performance, storing performance, and sheet positioning accuracy can be improved. Furthermore, there is a mechanism that, when the slide bottom plate is pulled out to load elongated sheets, raises a front-edge positioning stopper accordingly and that lowers it accordingly when it is housed; thus, the positioning accuracy for loading sheets is improved, and the operational performance for placing elongated sheets on a sheet feeding tray is improved. Furthermore, due to the connection mechanism for a bottom-plate extended section that moves vertically and a slide bottom plate section that slides to be pulled out, it is possible to reduce the weight of the bottom plate and prevent the bottom plate from being pulled out when it is moved up.

The above-described characteristics of the present invention are explained in detail with reference to the following drawings.

Configuration

Figure 1:
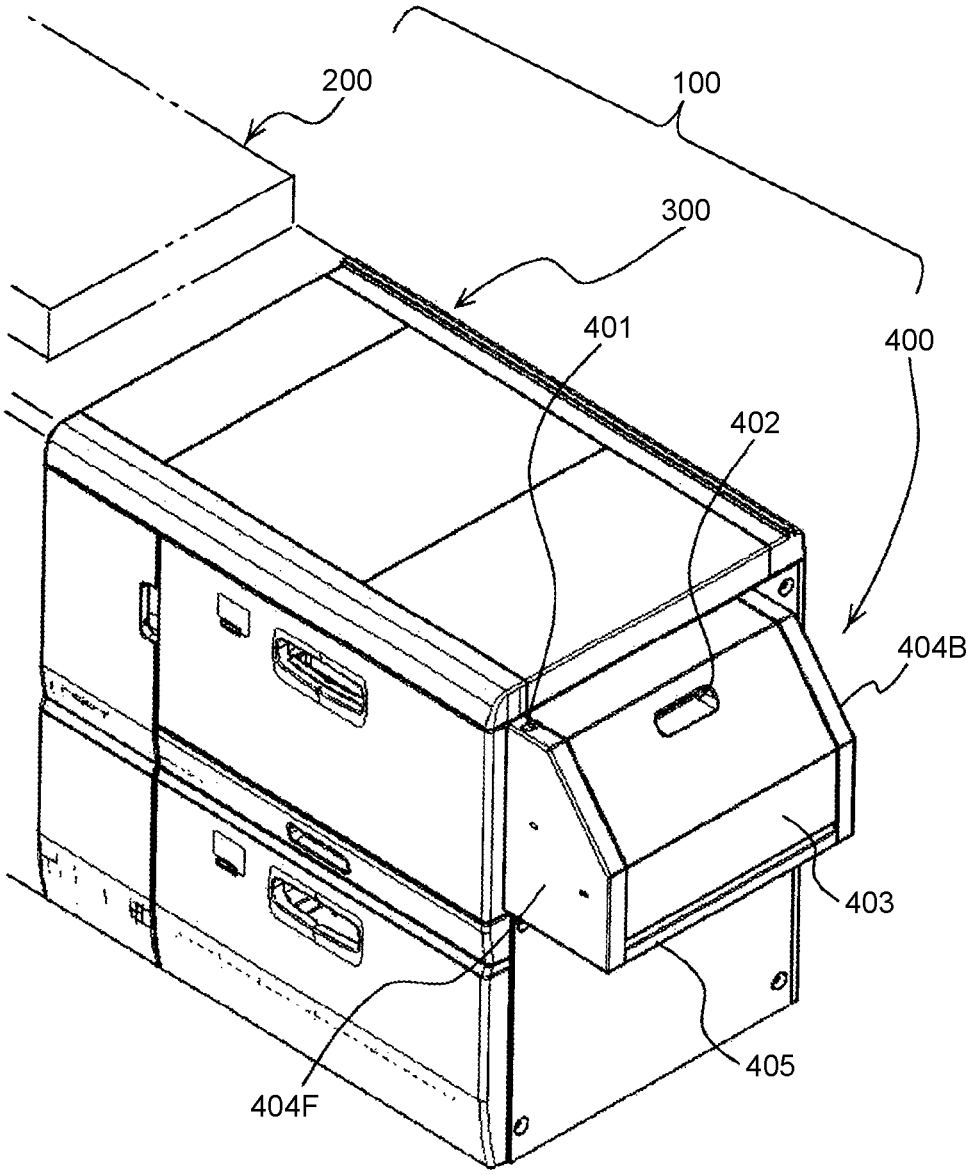
FIG. 1 is an explanatory diagram that illustrates the overall schematic configuration of an image forming apparatus according to an embodiment.

FIG. 1 is an explanatory diagram that illustrates the overall schematic configuration of an image forming apparatus according to an embodiment.

An image forming apparatus 100 includes a known image forming apparatus main body 200 and an apparatus in which an elongated-sheet auxiliary tray 400 is attached to an LCT 300 that is a sheet feeding device. In FIG. 1, the elongated-sheet auxiliary tray 400 is installed in the right upper tray of the LCT 300, i.e., on the first tray of the LCT 300.

It is assumed that the elongated-sheet auxiliary tray 400 does not include a CPU but includes a connector for connecting to the image forming apparatus main body 200, leads are connected from motors and various sensors to the connector, and an operation program is installed in the image forming apparatus main body 200 by using, for example, a CD-R that stores the operation program.

Figure 2:
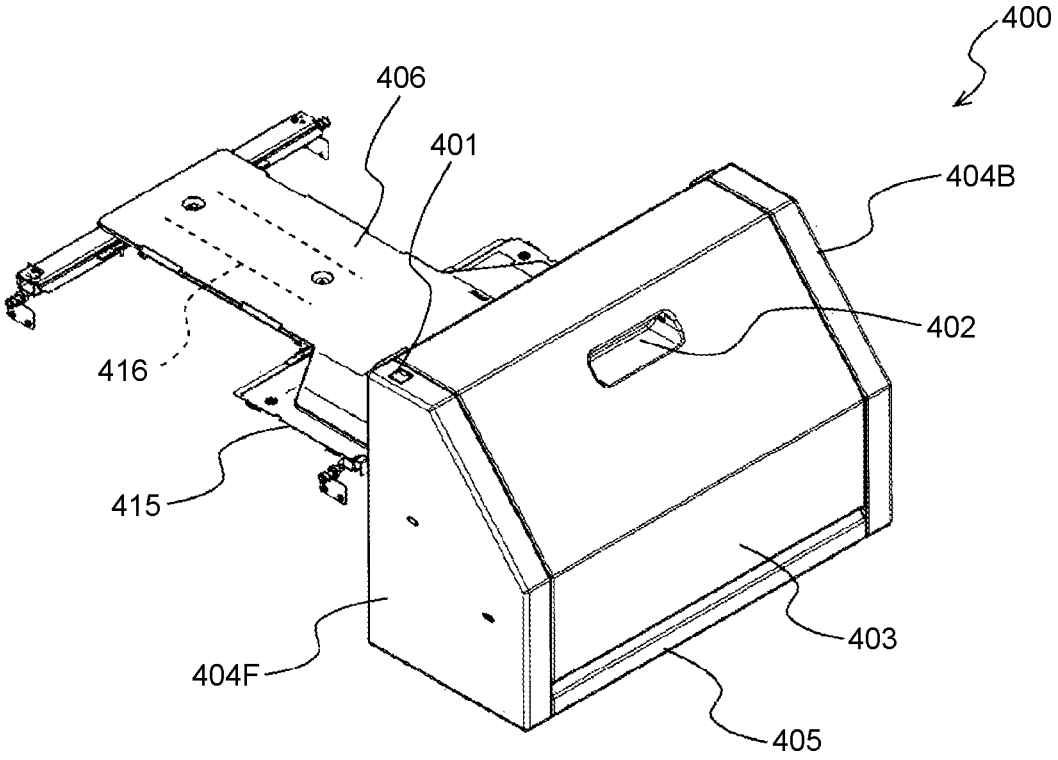
FIG. 2 is the external perspective view that illustrates an elongated-sheet auxiliary tray alone.

FIG. 2 is the external perspective view that illustrates the elongated-sheet auxiliary tray 400 alone.

The elongated-sheet auxiliary tray 400 includes, as an outer covering, a front cover 404F, a back cover 404B, an opening and closing cover 403, and a lower cover 405. Although not illustrated, the opening and closing cover 403 includes a supporting point and a hinge mechanism in its lower section, and a configuration is such that a user holds a handle 402 of the opening and closing cover 403 so as to open and close the opening and closing cover 403.

Furthermore, although not illustrated, the opening and closing angle of the opening and closing cover 403 can be fixed to any angle by using a magnet, a stopper, or the like. Moreover, although not illustrated, the opening and closing cover 403 includes an interlock mechanism, and a mechanism is provided which, when the opening and closing cover 403 is opened, makes a notification to the main body of the LCT 300 that the opening and closing cover 403 is opened and which stops the operation of the LCT 300.

A bottom-plate lifting and lowering switch 401 that is illustrated in the drawing is a switch that generates a signal for lowering a tray bottom plate 415, which is located inside the elongated-sheet auxiliary tray 400, to a location where sheets can be fed, and the tray bottom plate 415 is configured to move down when a user presses the switch to supply elongated sheets.

Figure 3:
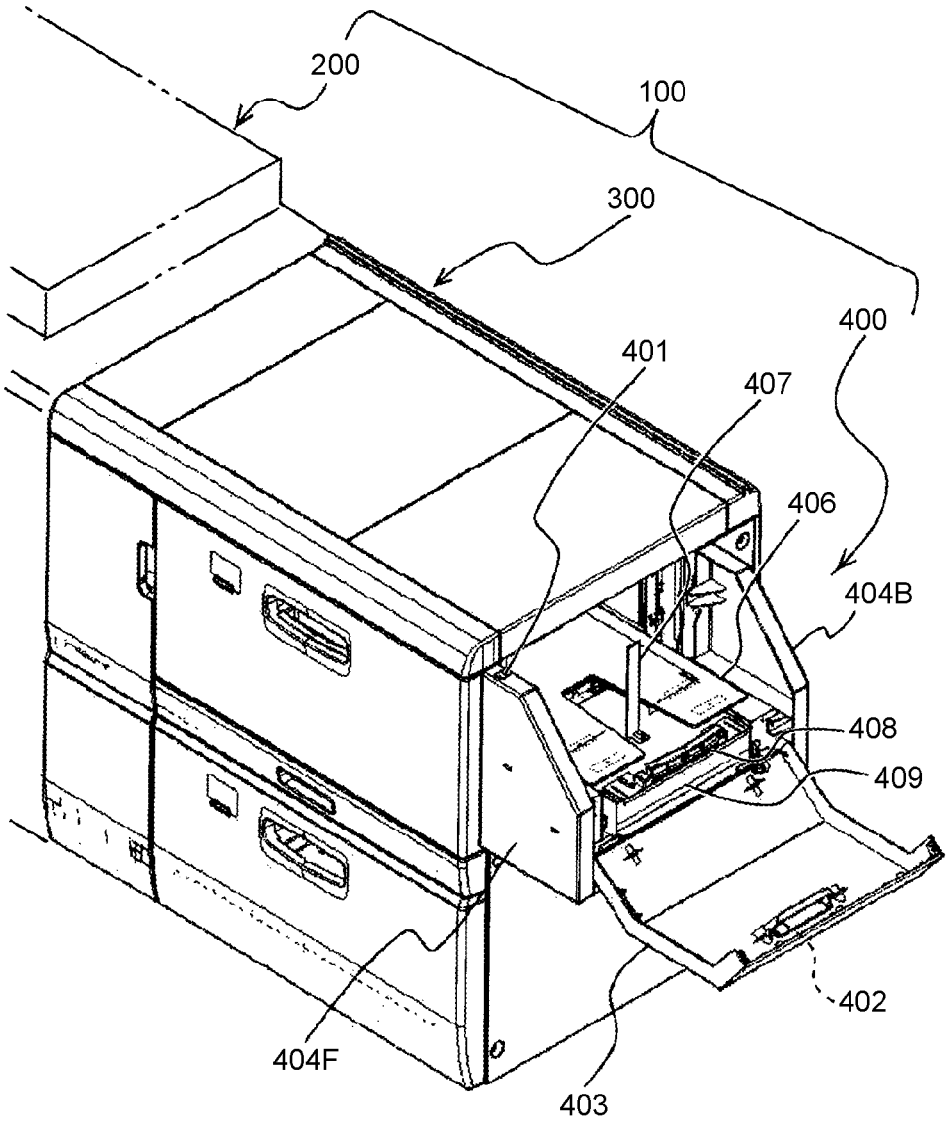
FIG. 3 is a diagram that illustrates a state where an opening and closing cover of the elongated-sheet auxiliary tray, which is placed in an LCT, is opened.

FIG. 3 is a diagram that illustrates a state where the opening and closing cover 403 of the elongated-sheet auxiliary tray 400, which is placed in the LCT 300, is opened.

Figure 4:
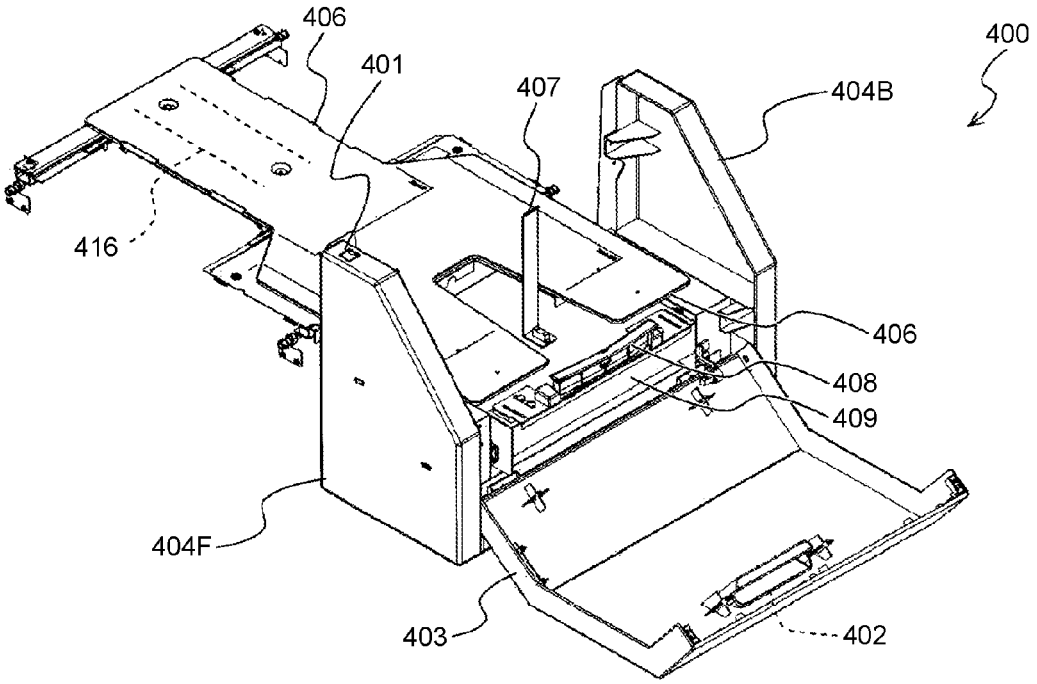
FIG. 4 is the external perspective view that illustrates the elongated-sheet auxiliary tray alone in the state illustrated in FIG. 3.

FIG. 4 is the external perspective view that illustrates the elongated-sheet auxiliary tray 400 alone in the state illustrated in FIG. 3.

Figure 5:
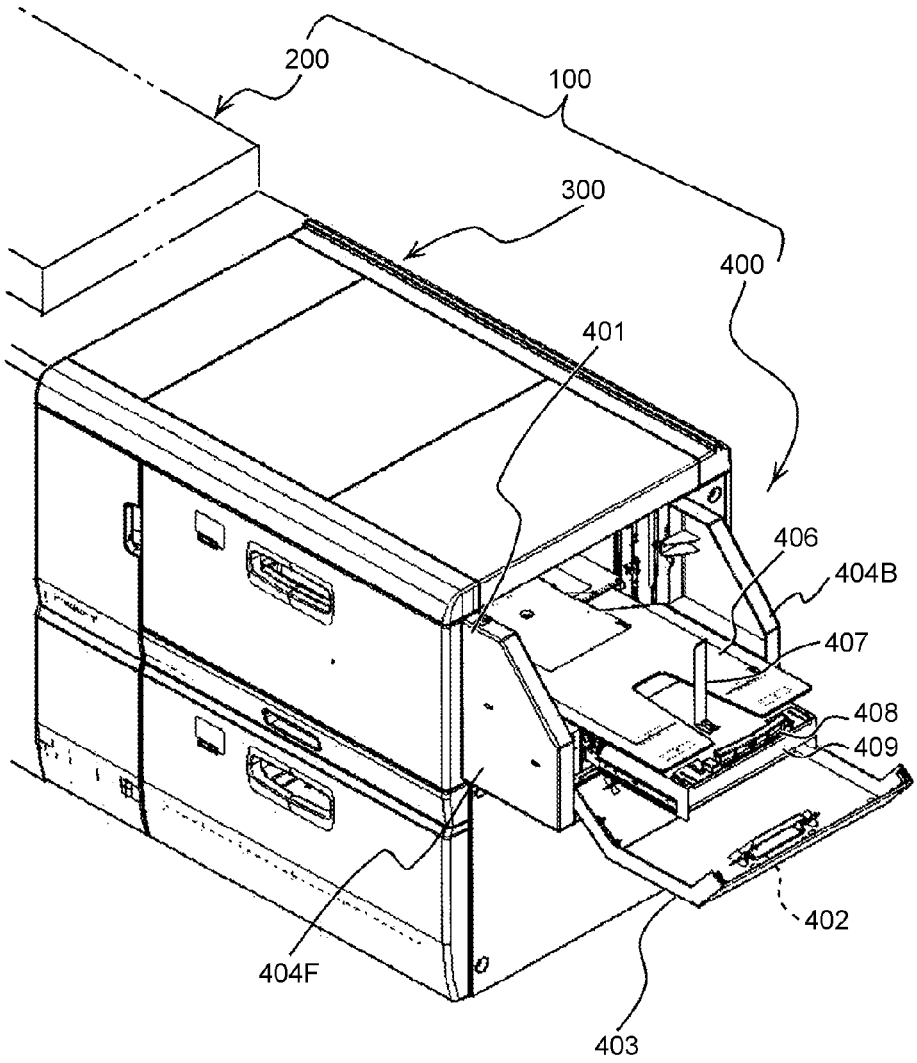
FIG. 5 is the external perspective view that illustrates a state where a pullout unit has been pulled out with a handle from the elongated-sheet auxiliary tray in the state illustrated in FIG. 4.

FIG. 5 is the external perspective view that illustrates a state where a pullout unit 409 has been pulled out with a handle 408 from the elongated-sheet auxiliary tray 400 in the state illustrated in FIG. 4.

Figure 6:
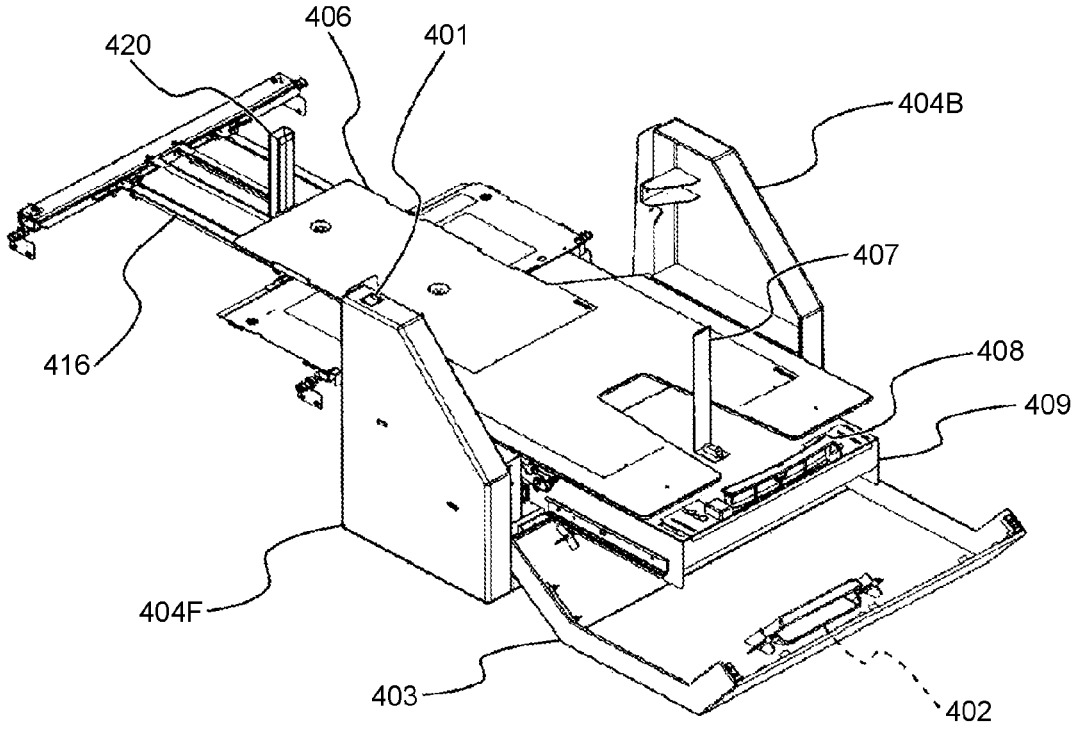
FIG. 6 is the external perspective view that illustrates a state where the opening and closing cover of the elongated-sheet auxiliary tray is opened.

FIG. 6 is the external perspective view of the elongated-sheet auxiliary tray 400 alone in the state illustrated in FIG. 5.

The handle 408 is attached to the pullout unit 409, and the pullout unit 409 is connected to a slide bottom plate 406.

Furthermore, after the pullout unit 409 is pulled out with the handle 408, the slide bottom plate 406 is accordingly pulled out. Moreover, after the slide bottom plate 406 is pulled out, a front-edge stopper 420, which is a front-edge sheet positioning unit for an elongated sheet 10, is accordingly raised (see FIG. 6).

Figure 7:
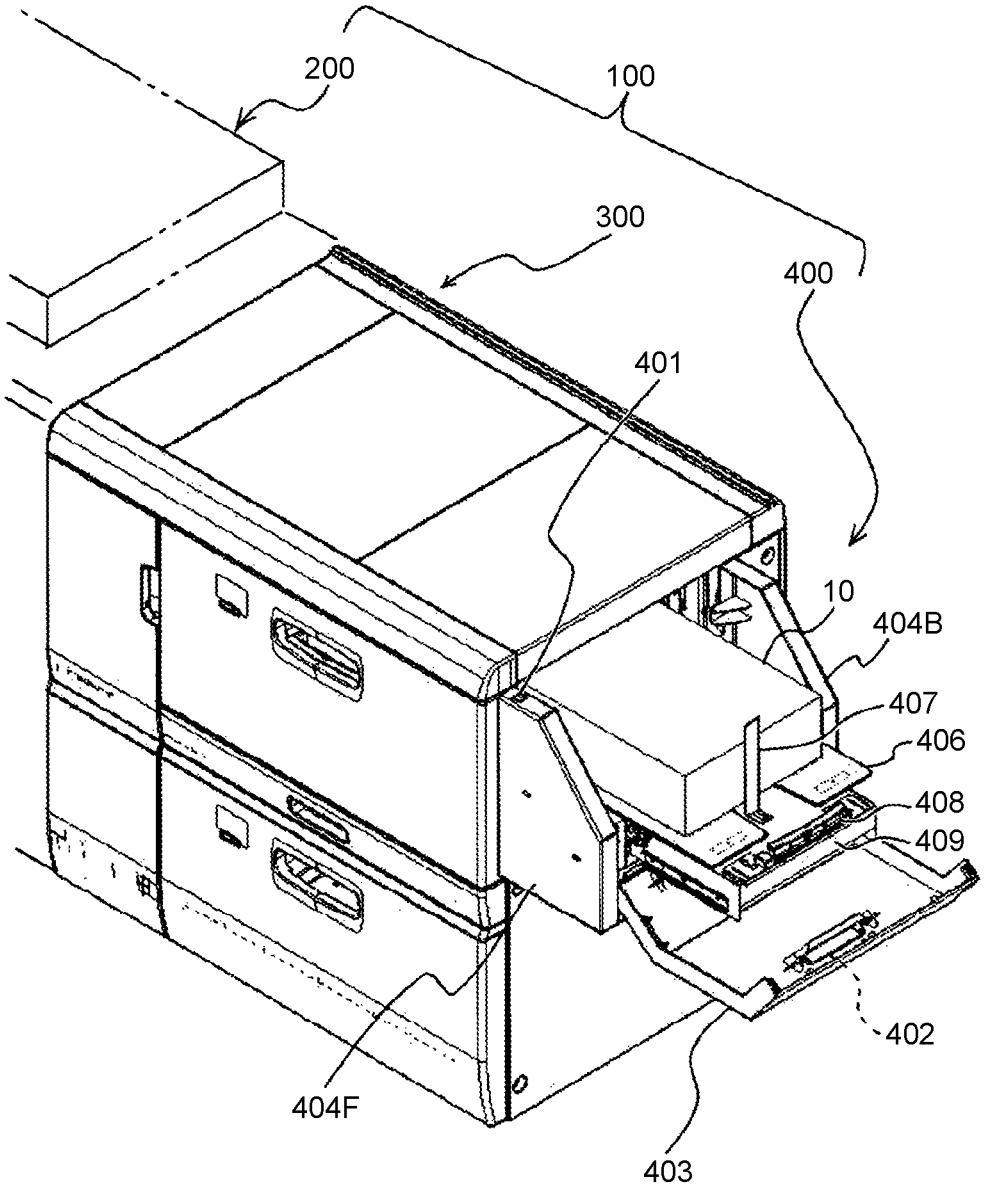
FIG. 7 is the external perspective view that illustrates a state where elongated sheets are placed on the elongated-sheet auxiliary tray of the LCT.

FIG. 7 is the external perspective view that illustrates a state where the elongated-sheet auxiliary tray is placed in the LCT 300 and the elongated sheets 10 are placed on the elongated-sheet auxiliary tray 400.

Figure 8:
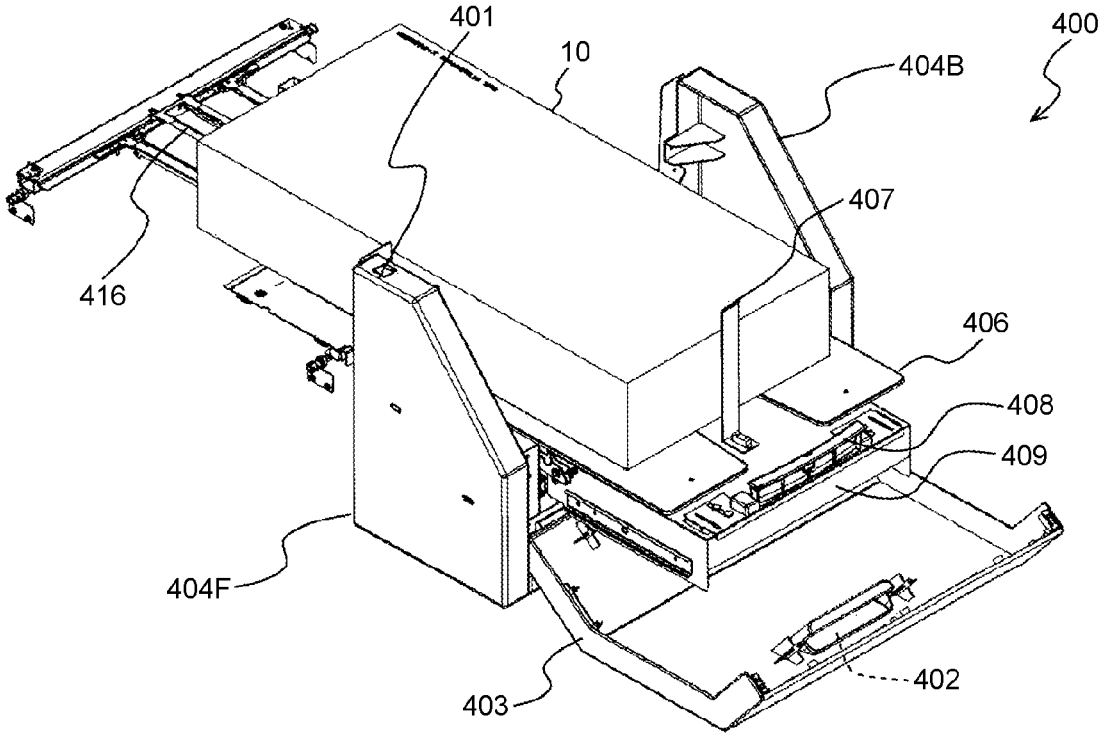
FIG. 8 is the external perspective view that illustrates a state where the elongated sheets are placed on the elongated-sheet auxiliary tray.

FIG. 8 is the external perspective view that illustrates a state where the elongated sheets 10 are placed on the elongated-sheet auxiliary tray 400.

An end fence 407 is a sheet-end positioning unit that adjusts the position of the end of the elongated sheet 10, and a configuration is such that the end fence 407 is secured to the pullout unit 409 with an undepicted magnet and it can be removed when sheets are supplied. Furthermore, although the single end fence 407 is illustrated in the drawing, the multiple end fences 407 may be provided.

In conventional sheet feeding devices that do not include the elongated-sheet auxiliary tray 400 according to the present invention, when a user supplies elongated sheets, the user needs to perform tasks to hold a bundle of elongated sheets and lower it from the upper side of the sheet feeding device toward the bottom plate, which results in an extremely hard work and a poor working efficiency.

However, the elongated-sheet auxiliary tray 400 is provided according to the present invention; therefore, to supply elongated sheets, a user first opens the opening and closing cover 403 and pulls out the pullout unit 409 toward the front side of the device. The end fence 407 is then removed from the pullout unit 409, whereby the elongated sheets can be supplied by being inserted onto the slide bottom plate 406 from the side of the device. Thus, it is possible to improve the efficiency of an operation to supply sheets further than in the past.

The position of the end fence 407, which is a rear-edge sheet positioning unit, is different depending on the length of the elongated sheet 10; therefore, if the end fence 407 is pulled toward a user in synchronization with the slide bottom plate 406, it is easily accessed and is removed without difficulty.

Figure 9:
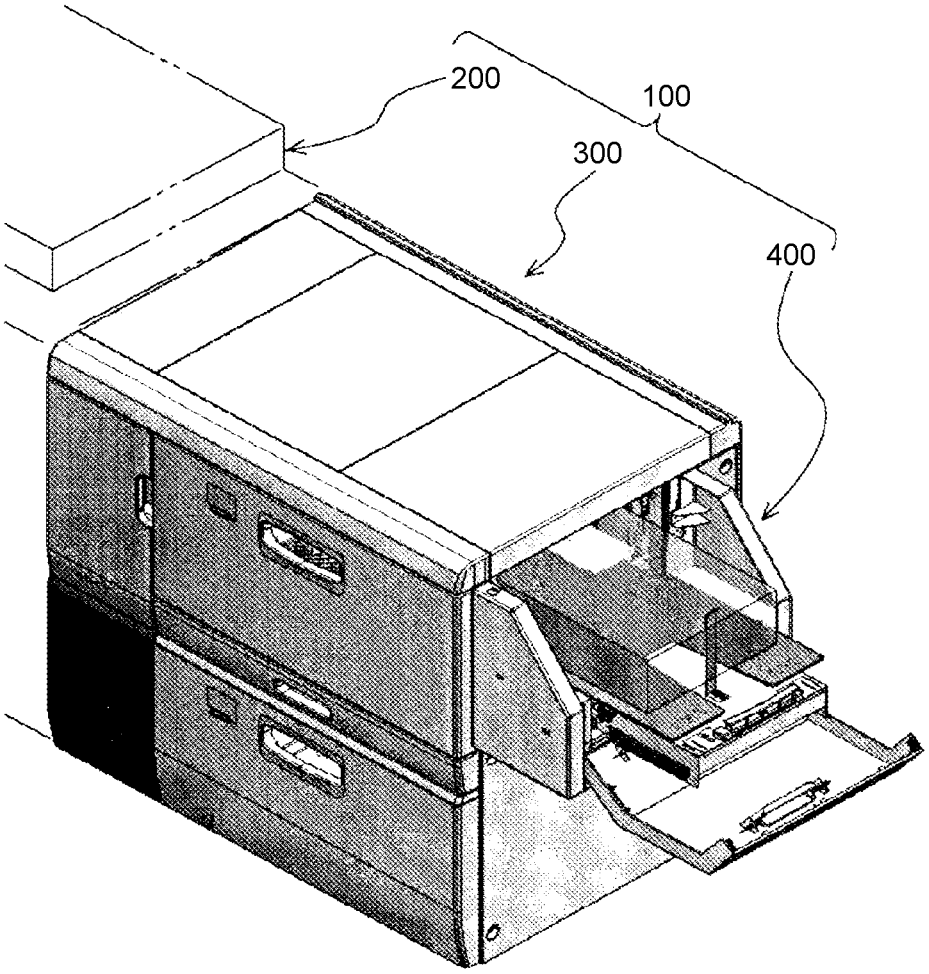
FIG. 9 is a partially transparent view of FIG. 7.

FIG. 9 is a partially transparent view of FIG. 7.

Figure 10:
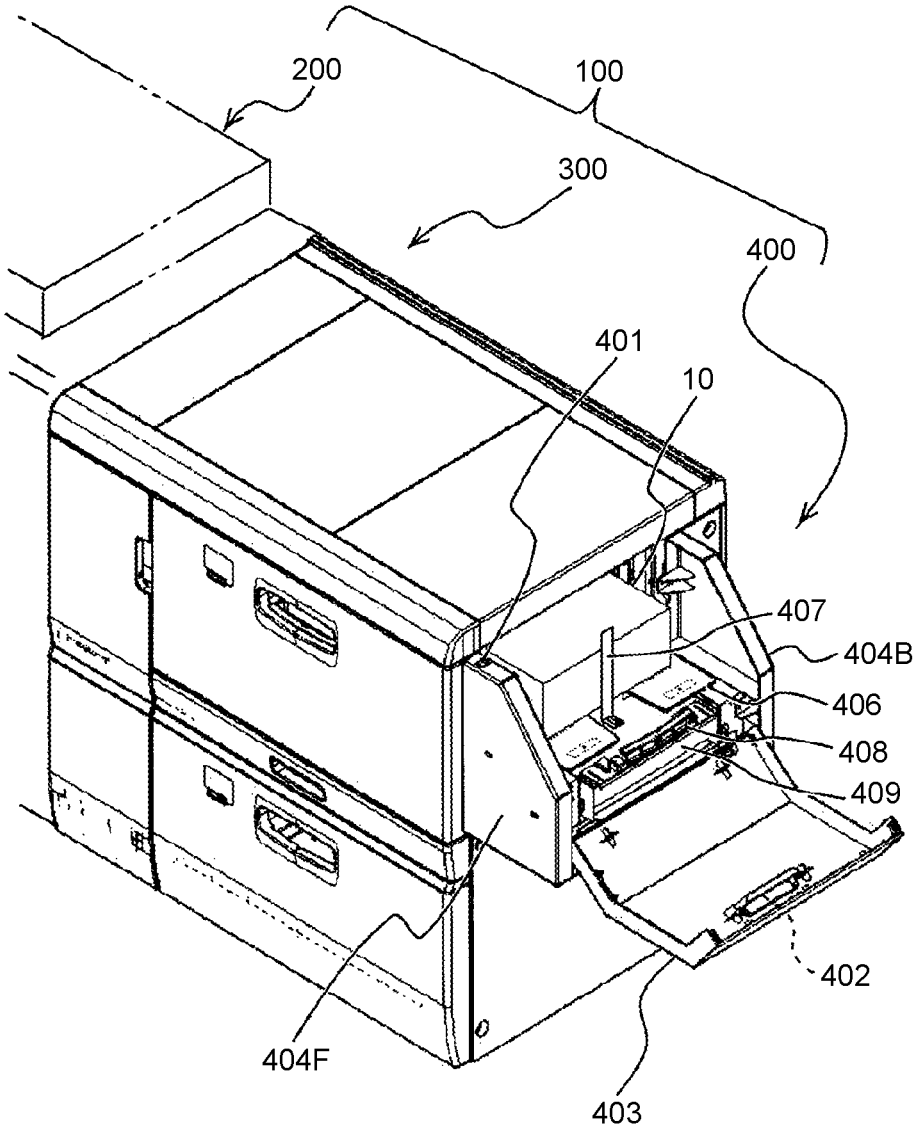
FIG. 10 is the external perspective view that illustrates a state where the handle is pushed in after the elongated sheets are placed on the elongated-sheet auxiliary tray of the LCT.

FIG. 10 is the external perspective view that illustrates a state where the handle 408 is pushed in after the elongated sheets 10 are placed on the elongated-sheet auxiliary tray 400 that is placed in the LCT 300.

Figure 11:
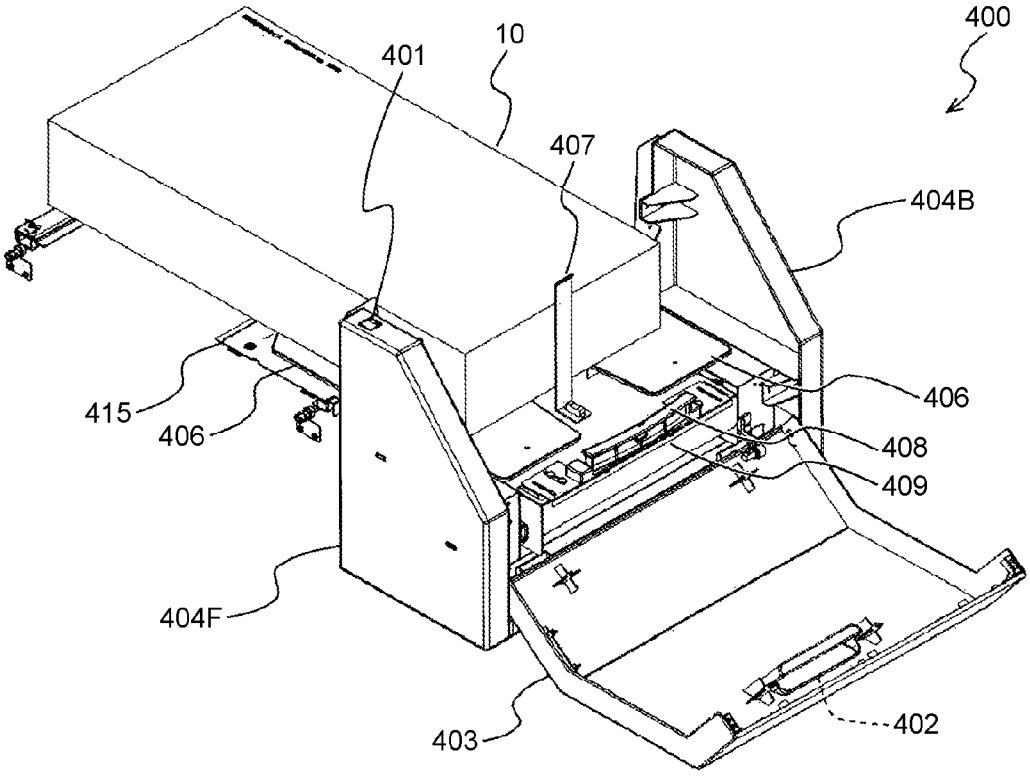
FIG. 11 is the external perspective view of the elongated-sheet auxiliary tray that is illustrated in FIG. 10.

FIG. 11 is the external perspective view of the elongated-sheet auxiliary tray 400 that is illustrated in FIG. 10.

When the elongated sheets 10 are pushed into the elongated-sheet auxiliary tray 400, the front-edge stopper 420 is moved down in accordance with the movement of the slide bottom plate 406 so as not to interfere with a supply of the elongated sheets 10.

Figure 12:
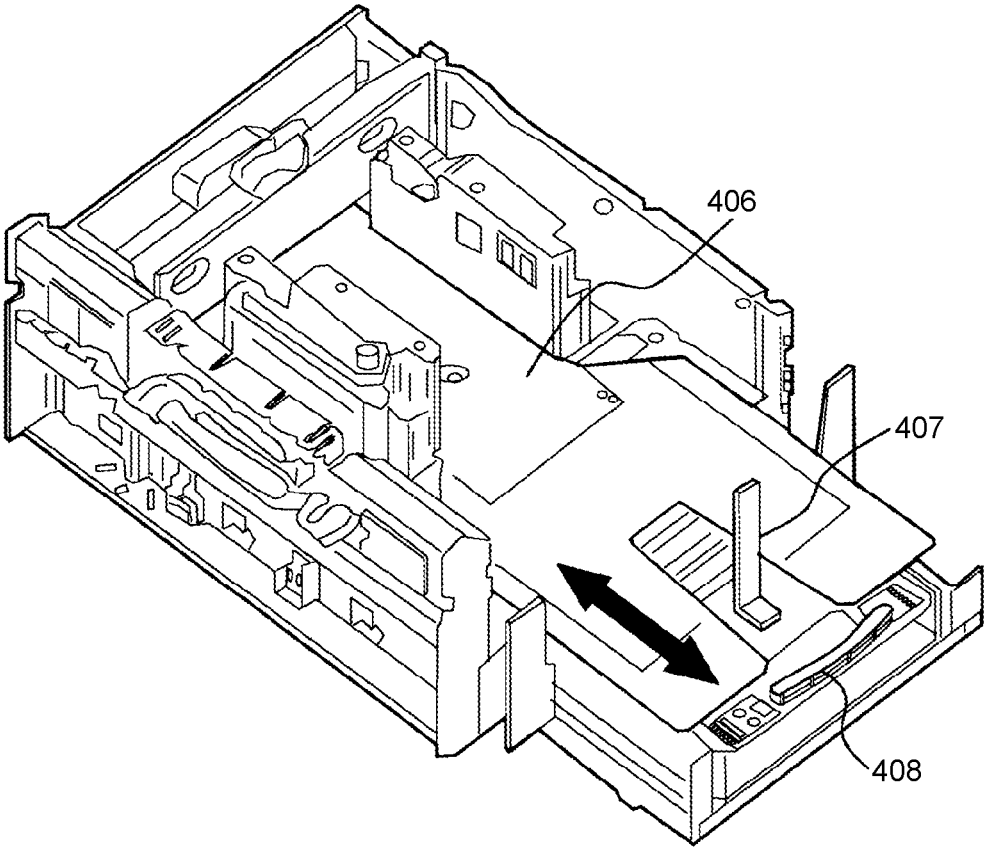
FIG. 12 is the external perspective view that illustrates a state where a slide bottom plate is placed on a sheet feeding tray of the elongated-sheet auxiliary tray.

FIG. 12 is the external perspective view that illustrates a state where the slide bottom plate 406 is placed on the sheet feeding tray of the elongated-sheet auxiliary tray 400.

Figure 13:
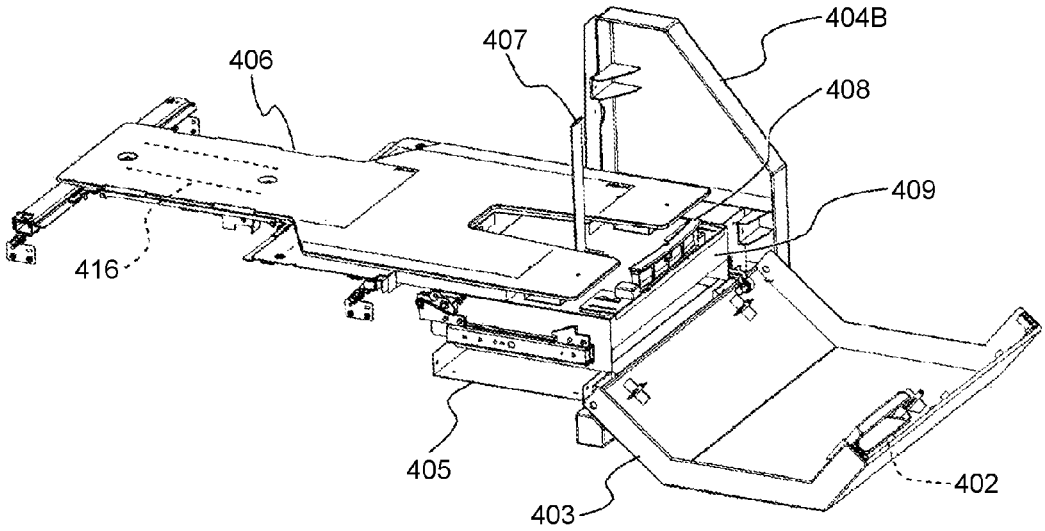
FIG. 13 is the external perspective view that illustrates a state where the pullout unit connects to a slide unit.

FIG. 13 is the external perspective view that illustrates a state where the pullout unit 409 connects to a slide unit 416.

Figure 14:
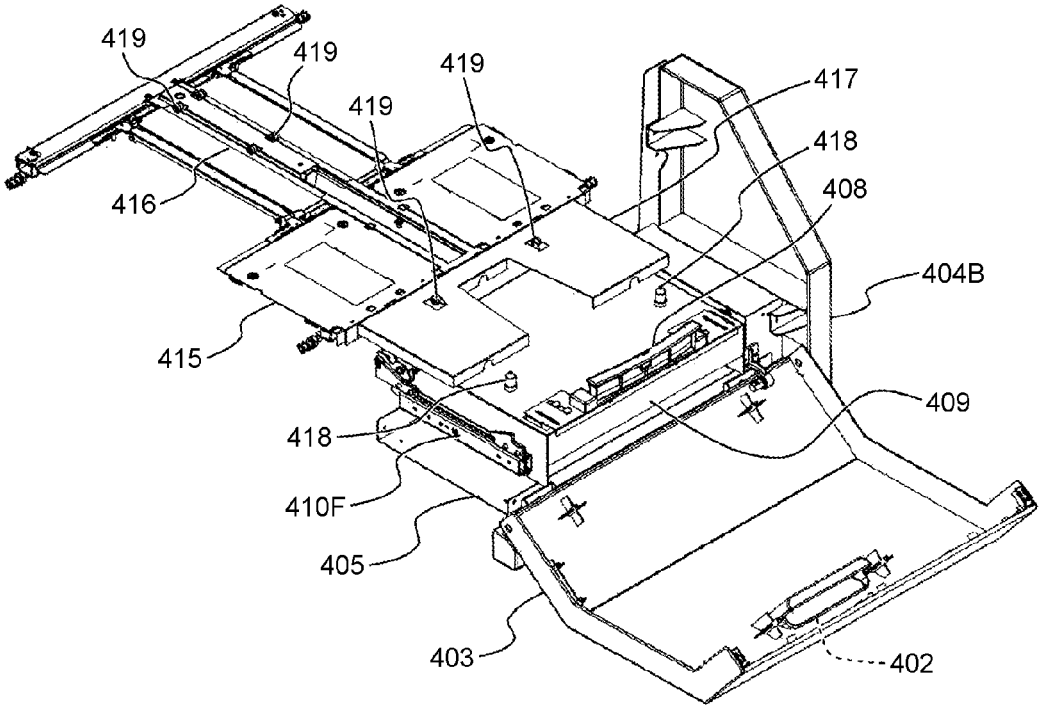
FIG. 14 illustrates, in an easily viewable way, a tray bottom plate that is located under the slide bottom plate.

FIG. 14 illustrates, in an easily viewable way, the tray bottom plate 415 that is located under the slide bottom plate 406.

The reference numeral 417 denotes an extended tray, and it is provided such that it extends from the tray bottom plate 415 toward the handle 408.

The extended tray 417 and the slide bottom plate 406 mounted on the tray bottom plate 415 are configured to slide only at the bottom dead center of the slide bottom plate 406 (and the tray bottom plate 415 and the extended tray 417).

Figure 15A:
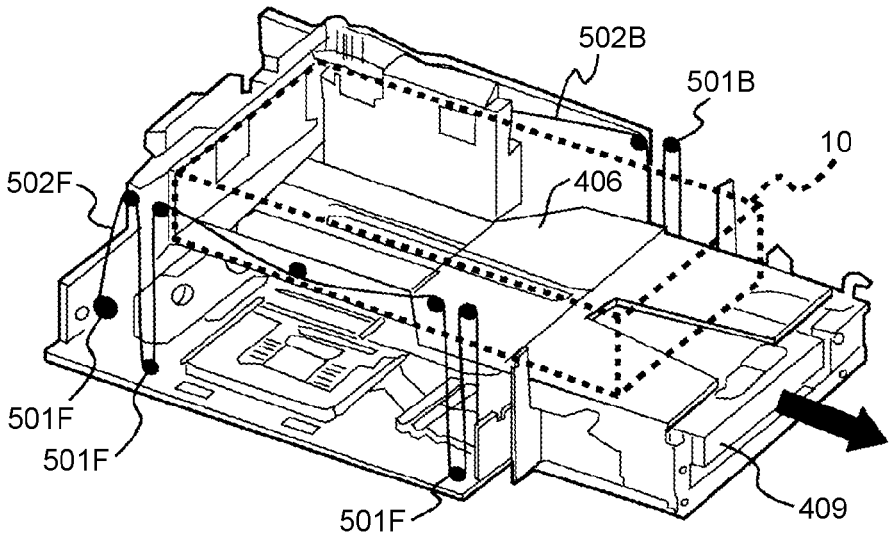
FIG. 15A is a transparent view that illustrates a state that is obtained before the pullout unit is pulled out.
Figure 15B:
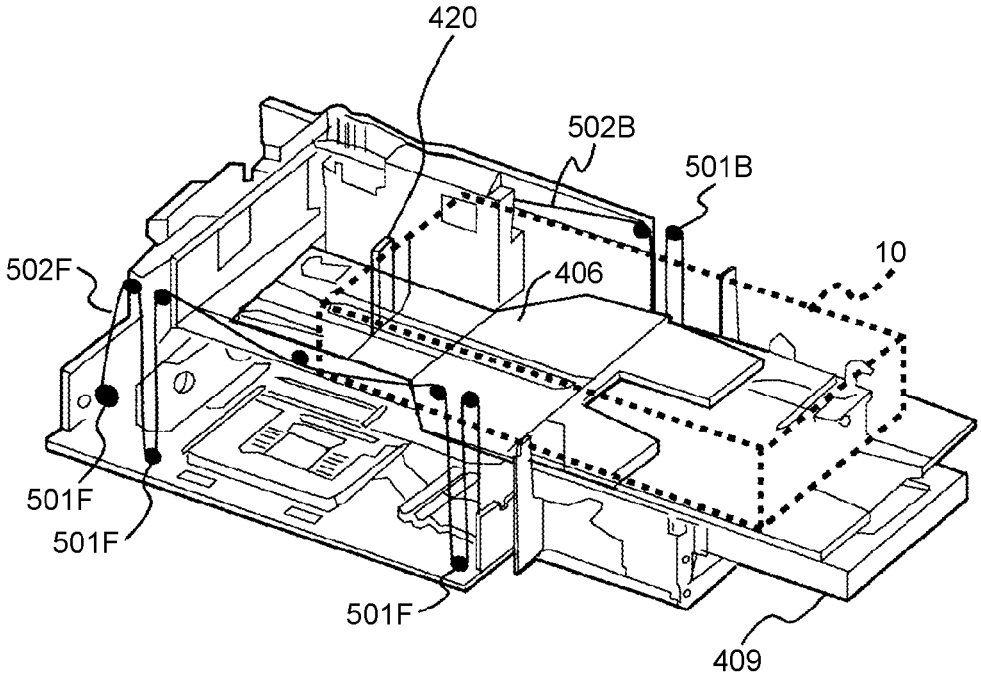
FIG. 15B is a transparent view that illustrates a state that is obtained after the pullout unit is pulled out.

FIG. 15A is a transparent view that illustrates a state that is obtained before the pullout unit 409 is pulled out, and FIG. 15B is a transparent view that illustrates a state that is obtained after the pullout unit 409 is pulled out.

The slide bottom plate 406 connects to the box-shaped slide unit 416 that is moveable toward the image forming apparatus main body 200, and it is configured to move on bearings 419. Furthermore, the pullout unit 409 connects to the structure of the elongated-sheet auxiliary tray 400 with slide rails 410F, 410B so that it can slide in a conveying direction as illustrated in FIG. 15. The slide bottom plate 406 is connected to the pullout unit 409 with connection pins 418 that are illustrated in FIG. 16, and they are configured to connect to each other at the lowest point of the slide bottom plate 406.

The slide bottom plate 406 is loaded with multiple sheets, especially the elongated sheets 10, and it can be lifted and lowered in a vertical direction by a loading unit. The loading unit includes pulleys 501F, 501B, wires 502F, 502B, and an undepicted motor. The wires 502F, 502B are wound up due to the rotation of the motor, the pulley at the bottom end is lifted up so that the slide bottom plate 406 is moved up, and the motor is rotated in reverse so that the slide bottom plate 406 is moved down; however, there is no limitation.

Here, the slide bottom plate 406 is moved up by using, as a trigger, a signal of an undepicted opening and closing cover detection sensor or switch, when the opening and closing cover 403 is closed. Although the opening and closing cover 403 can be freely opened and closed, the movement of the slide bottom plate 406 is made only when the opening and closing cover 403 is closed. Furthermore, the elongated sheet 10 is supplied when the slide bottom plate 406 is lowered to the bottom dead center. As the operation to raise the slide bottom plate 406 is performed for the operation to feed sheets, the operation is based on a determination made by the image forming apparatus main body 200 on the option side. The purpose of pressing a switch is only to lower the slide bottom plate 406 when elongated sheets are supplied or removed.

Figure 16:
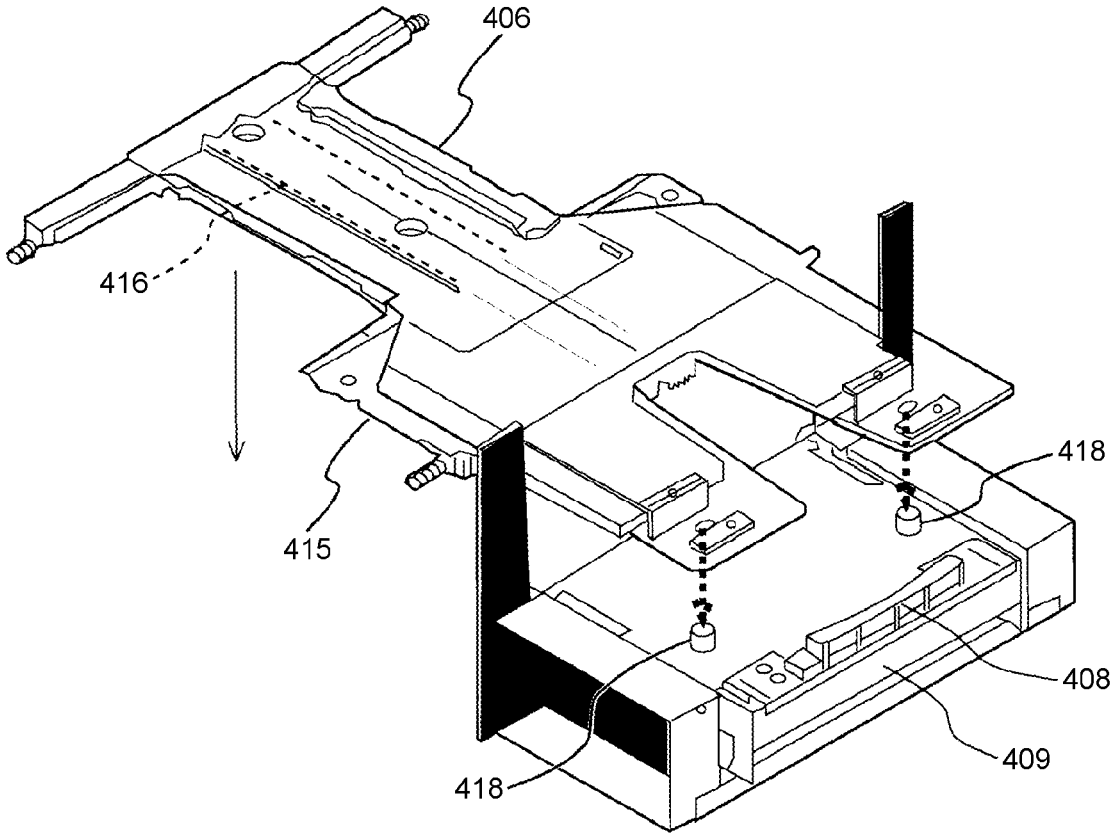
FIG. 16 is an explanatory diagram of the connection state of the pullout unit and the slide bottom plate.
Figure 17:
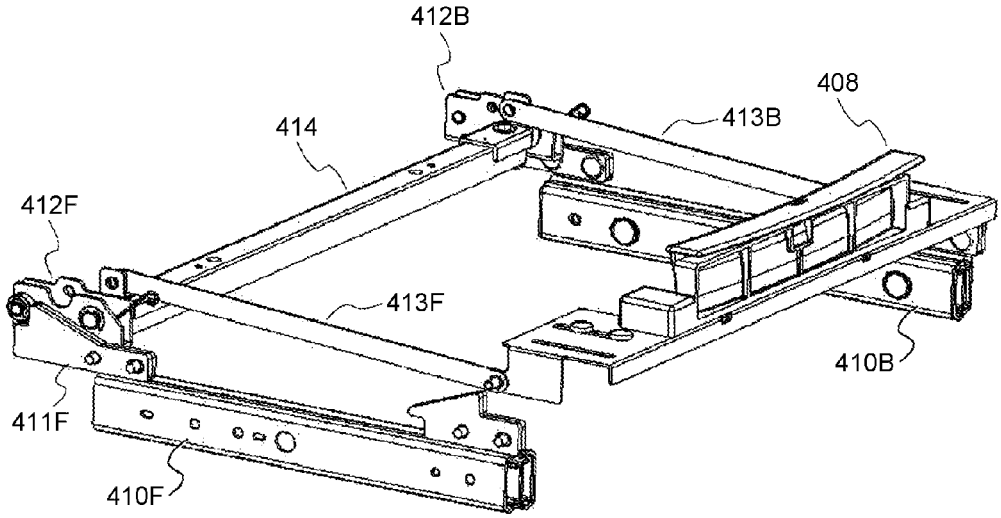
FIG. 17 is the external perspective view that illustrates the internal structure of the pullout unit.

FIG. 16 is an explanatory diagram of the connection state of the pullout unit 409 and the slide bottom plate 406. FIG. 17 is the external perspective view that illustrates the internal structure of the pullout unit 409.

When the handle 408 illustrated in FIG. 17 is pulled, a lock-arm rotary shaft 414 is rotated via links 413F, 413B, lock arms 412F, 412B are raised, and the lock of a stopper 1 (411F) and a stopper 2 (411B) that are installed in the structure of the elongated-sheet auxiliary tray 400 is released. Thus, it is possible to fix the slide bottom plate 406 when it is pulled out and pushed in.

Specifically, when the handle 408 is pulled to the right side in the drawing, the lock arm 412F is rotated in a clockwise direction around the axis on the right side of the lock arm 412F so as to be removed from the stopper 1. The same holds for the lock arm 412B. The lock arms 412F, 412B, the stopper 1 (411F), the stopper 2 (411B), and the links 413F, 413B constitute the lock mechanism that is a connection unit.

Figure 18:
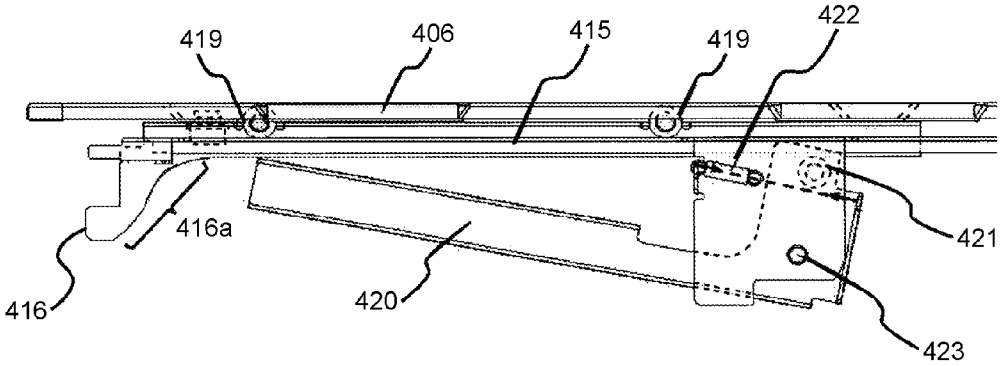
FIG. 18 is an explanatory diagram that illustrates an operational mechanical section of a front-edge stopper that is illustrated in FIG. 6.

FIG. 18 is an explanatory diagram that illustrates an operational mechanical section of the front-edge stopper 420 that is illustrated in FIG. 6.

The slide unit 416 is installed on the tray bottom plate 415 via the bearings 419. Furthermore, the front-edge stopper 420 is supported at a front-edge stopper rotation support 423 under the tray bottom plate 415 while it is loaded with a spring 422. A cam shaped section 416*a* is formed in the lower section of the slide unit 416, and it is slidably in contact with a rotatable cam roller 421 on which the front-edge stopper 420 is provided.

Here, "loaded" means a state where the illustrated spring 422 is actually located on the extreme right. The state is obtained such that a right-side hook of the spring 422 in FIG. 18 is put on the extreme right of the front-edge stopper 420, i.e., the section that is indicated by an arrow. This force allows the cam roller 421 to be always in contact with the cam shaped section 416*a*. If there is not the spring 422, the front-edge stopper 420 is tilted or backlashed due to its own weight. The load of the spring 422 prevents a backlash of the front-edge stopper 420 in the state of FIG. 19A and a backlash in the state of FIG. 19E.

Furthermore, the front-edge stopper 420, which is the front-edge sheet positioning unit, facilitates positioning as the front edge of the elongated sheet 10 is brought into contact with the front-edge stopper 420 when the elongated sheet 10 is placed on the tray. There may be the multiple front-edge stoppers 420 instead of the single front-edge stopper 420. The single front-edge stopper 420 is illustrated; however, if there are the multiple front-edge stoppers 420, positioning of the front edge of the elongated sheet 10 can be further facilitated.

Operation

Figure 19:
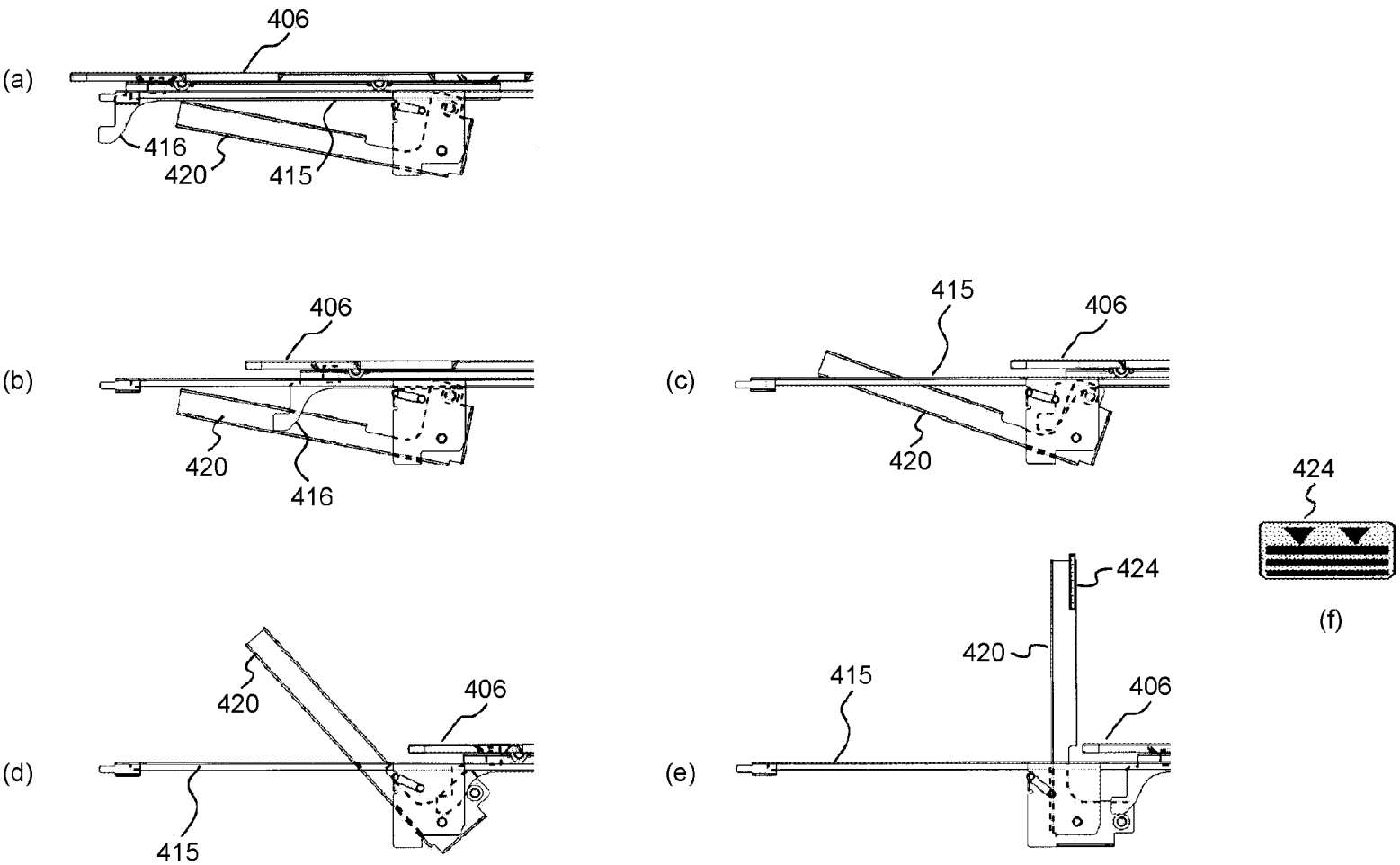
FIG. 19 is explanatory diagram that illustrates an operation of the front-edge stopper.

FIG. 19 is explanatory diagrams that illustrate an operation of the front-edge stopper.

FIG. 19(*a*) illustrates a state where the front-edge stopper 420 is housed under the tray bottom plate 415 and a state where the slide bottom plate 406 is pushed in relative to the sheet feeding tray. FIG. 19(*b*) is a diagram that illustrates a state where the slide bottom plate 406 has started to be pulled out and the cam shaped section 416*a*, which is located in the lower section of the slide unit 416, and the cam roller 421 of the front-edge stopper 420 are moved while they are in contact with each other. FIG. 19(*c*) is a diagram that illustrates a state where the front-edge stopper 420 has started to be raised due to the cam line. FIG. 19(*d*) is a diagram that illustrates a state where the front-edge stopper 420 is further raised. FIG. 19(*e*) is a diagram that illustrates a state where the front-edge stopper 420 is fixed at the lowest point of the cam line. FIG. 19(*f*) illustrates an indication that is provided on the end of the front-edge stopper 420 and that indicates the upper limit of a quantity of loaded sheets, especially, the elongated sheets 10.

The front-edge stopper 420, which is the front-edge sheet positioning unit, moves in synchronization with the slide bottom plate 406.

Figure 20:
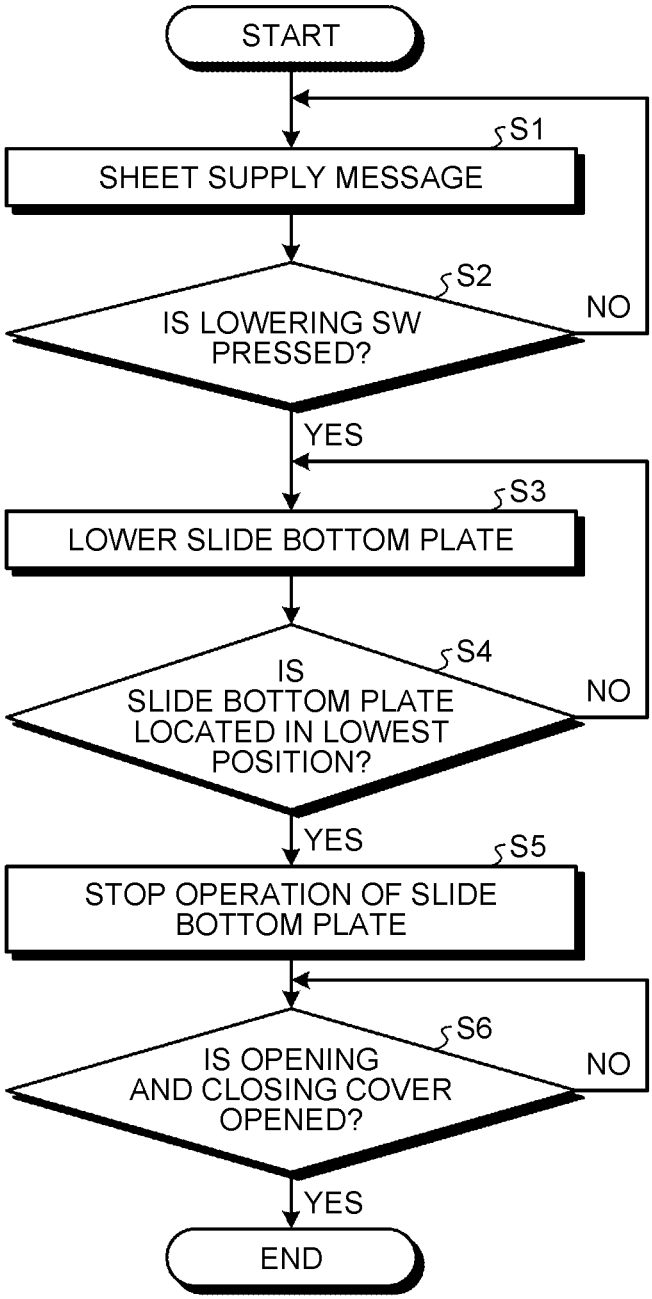
FIG. 20 is an example of a flowchart that illustrates an operation that is performed before the opening and closing cover is opened to supply the elongated sheets.

FIG. 20 is an example of a flowchart that illustrates an operation that is performed before the opening and closing cover is opened to supply the elongated sheets.

Figure 22:
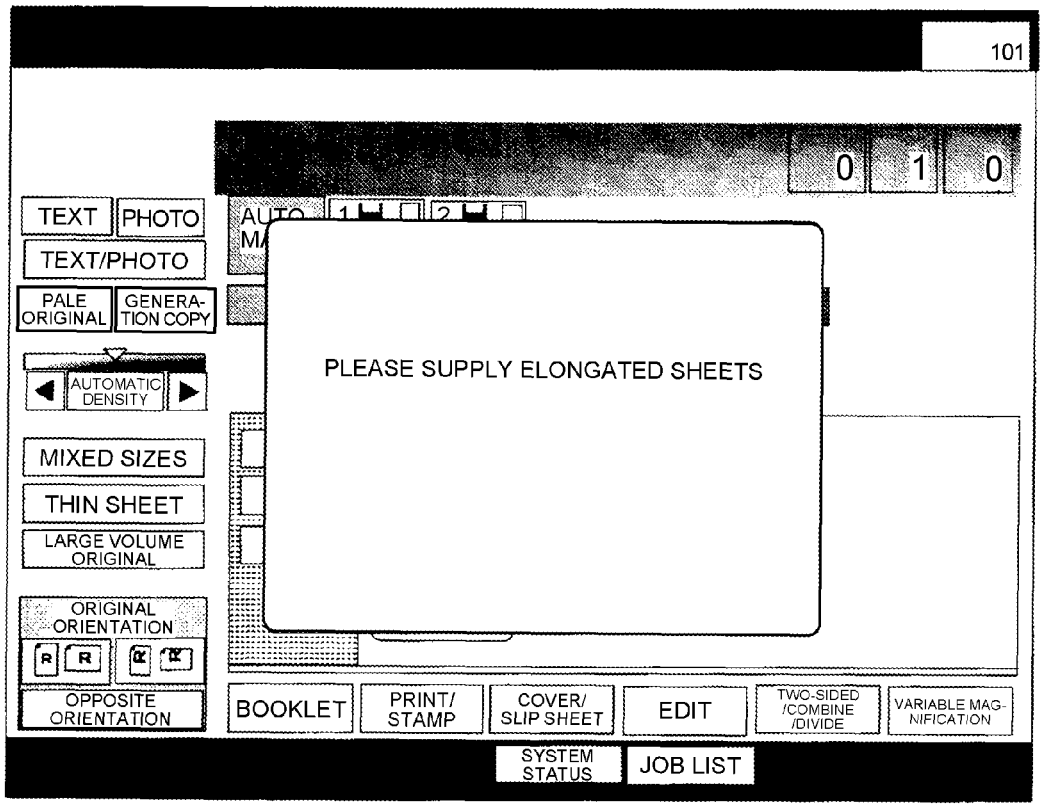
FIG. 22 is a diagram that illustrates an example of a supply message that is displayed on an operation panel of an image forming apparatus main body to supply the elongated sheets.

When the elongated sheet 10 is not present on the sheet feeding tray, a sheet supply message is displayed on an undepicted operation panel of the image forming apparatus main body 200 (Step S1: see FIG. 22 with regard to the operation panel screen).

A stand-by state maintains until a user presses a bottom-plate lowering SW 401 of the elongated-sheet auxiliary tray (Step S2).

When the bottom-plate lowering SW 401 of the slide bottom plate 406 is pressed, an operation is performed to lower the slide bottom plate 406 (Step S3).

A check is made as to whether the slide bottom plate 406 reaches the lowest position and, if not, the slide bottom plate 406 continues to be lowered (Step S4).

If the slide bottom plate 406 reaches the lowest position, the operation to lower the slide bottom plate 406 is stopped (Step S5).

A stand-by state maintains until a user opens the opening and closing cover (Step S6).

Figure 21:
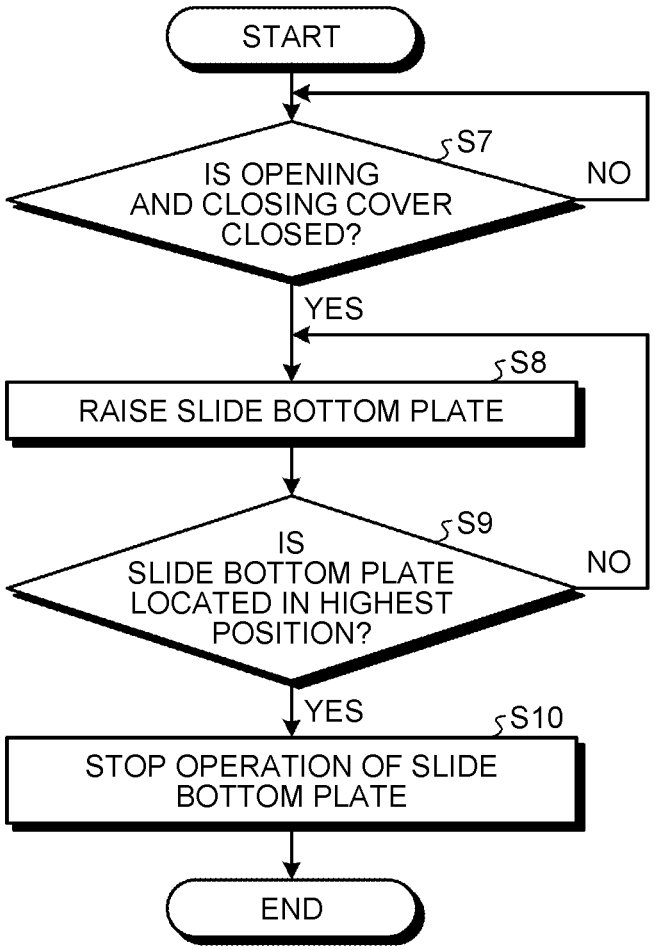
FIG. 21 is an example of the flowchart that illustrates an operation by which a sheet-feeding standby state is obtained after the elongated sheets are supplied.

FIG. 21 is an example of the flowchart that illustrates an operation by which a sheet-feeding standby state is obtained after the elongated sheets 10 are supplied.

A stand-by state maintains until a user completes a supply of the elongated sheet 10 and the opening and closing cover 403 is closed (Step S7).

When the opening and closing cover 403 is closed, the slide bottom plate 406 is raised (Step S8).

A check is made as to whether the slide bottom plate 406 reaches the highest position (sheet feeding position) and, if not, the slide bottom plate 406 continues to be raised (Step S9).

If the slide bottom plate 406 reaches the highest position, the operation to raise the slide bottom plate 406 is stopped (Step S10).

FIG. 22 is a diagram that illustrates an example of a supply message that is displayed on the operation panel of the image forming apparatus main body 200 to supply the elongated sheets 10.

For example, as illustrated in FIG. 22, "please supply elongated sheets" is displayed until elongated sheets are supplied. This display allows a user to know that the elongated sheets have run out and immediately supply elongated sheets.

As described above, the slide bottom plate is provided which slides when elongated sheets are placed, the mechanism is provided which pulls out the slide bottom plate for a supply when sheets are supplied, and the mechanism is provided which raises the front-edge positioning stopper when the slide bottom plate is pulled out for loading and which lowers it when it is housed. Thus, the mechanism is provided which connects between the bottom-plate extended section that moves vertically and the slide bottom plate section that slides to be pulled out; thus, elongated sheets can be supplied without making major changes on the configuration of the existing tray.

Furthermore, the above-described embodiment is an example of the preferred embodiment of the present invention; therefore, the present invention is not limited to it, and various modifications may be made without departing from the scope of the present invention. For example, in the above-described embodiment, an explanation is given of a case where an installation is made in the upper tray of the sheet feeding device; however, the present invention is not limited to it, and an installation may be made in a plurality of trays.

According to the present invention, it is possible to provide a sheet feeding device that can store elongated sheets in a stable manner and that can supply sheets with high-accuracy positioning without making major changes on the structure of the existing tray.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a loading unit that lifts and lowers a loaded sheet;

a sheet-end positioning unit that adjusts a position of an end of the sheet;

a conveying unit that conveys the sheet to an image forming apparatus main body;

a plurality of slide rails that are attached to the sheet feeding device;

a pullout unit that is movable toward the image forming apparatus main body on the slide rails;

an extended tray that is installed on a slide bottom plate so as to extend therefrom;

the slide bottom plate that is movable up and down by the loading unit and that is slidable on the pullout unit in a horizontal direction;

a front-edge sheet positioning unit that raises up when the slide bottom plate is pulled out in a horizontal direction and that falls down when the slide bottom plate is pushed in a horizontal direction; and a connection unit that connects to a handle for pulling out the pullout unit in a horizontal direction when the slide bottom plate is located at a lowest point.

2. The sheet feeding device according to claim 1, further comprising a rear-edge sheet positioning unit that moves in synchronization with the slide bottom plate.

3. The sheet feeding device according to claim 1, wherein the front-edge sheet positioning unit has an indication that indicates an upper limit of a quantity of loaded sheets.

4. The sheet feeding device according to claim 1, wherein the extended tray slides only at a bottom dead center of the slide bottom plate.

5. The sheet feeding device according to claim 1, wherein the front-edge sheet positioning unit holds a plurality of areas.

6. The sheet feeding device according to claim 1, wherein the slide bottom plate has a lock mechanism for a slide.

7. The sheet feeding device according to claim 1, wherein a distance for which the slide bottom plate slides is a distance for which the slide bottom plate is supported by a side fence.

8. The sheet feeding device according to claim 1, wherein an installation is possible in a plurality of trays of the sheet feeding device.

9. An image forming apparatus according to claim 1, the image forming apparatus comprising the sheet feeding device of claim 1.

* * * * *